US006908354B1

(12) United States Patent
Nakata

(10) Patent No.: US 6,908,354 B1
(45) Date of Patent: Jun. 21, 2005

(54) METHOD OF PRODUCING FLAT PANEL DISPLAYS

(75) Inventor: Kohei Nakata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 869 days.

(21) Appl. No.: 09/704,749

(22) Filed: Nov. 3, 2000

Related U.S. Application Data

(63) Continuation of application No. PCT/JP00/01436, filed on Mar. 9, 2000.

(30) Foreign Application Priority Data

Mar. 10, 1999 (JP) ..... 11-063859

(51) Int. Cl.[7] ..... H01J 9/00; H01J 9/24
(52) U.S. Cl. ..... 445/24
(58) Field of Search ..... 445/24, 25, 44; 313/495

(56) References Cited

U.S. PATENT DOCUMENTS 5,525,861 A 6/1996 Banno et al. ..... 313/495
5,925,979 A 7/1999 Azuma et al. ..... 313/495
5,997,378 A * 12/1999 Dynka et al. ..... 445/25
6,545,410 B1 * 4/2003 Wu et al. ..... 313/582

FOREIGN PATENT DOCUMENTS

JP 4-67533 3/1992
JP 9-50767 2/1997

* cited by examiner

*Primary Examiner*—Stephen Husar
*Assistant Examiner*—Sumati Krishnan
(74) *Attorney, Agent, or Firm*—Fitzpatrick, Cella, Harper & Scinto

(57) ABSTRACT

A method for producing a flat panel display including a face plate portion and a rear plate portion opposite to each other, and a frame portion, includes a step of adhering a portion between the face plate and the rear plate while guiding by a jig. The jig functions as a guide such that the relative positions between the face plate and the rear plate are in a predetermined state at least in a direction within a plane of the plates, and movement in an interval direction of the face plate and the rear plate can be allowed.

10 Claims, 10 Drawing Sheets

METHOD OF PRODUCING FLAT PANEL DISPLAYS

This application is a continuation of International Application No. PCT/JP00/01436, filed Mar. 9, 2000, designated the United States, which claims the benefit of Japanese Application No. 11-063859, filed Mar. 10, 1999, which is incorporated herein by reference in its entirety.

TECHNICAL FIELD

The present invention relates to a method for producing a flat type image forming apparatus (hereinafter referred to as a flat panel display).

BACKGROUND ART

The prior art will be described below by referring to FIGS. 13 through 22.

FIG. 22 is a sectional view of a flat panel display 200. The flat panel display 200 is formed by a face plate 201, a rear plate 202, and a frame 203 connecting the face plate 201 to the rear plate 202. Since the flat panel display is a vacuum inside, it includes an atmospheric-pressure-resistant support member 204 to withstand the atmospheric pressure.

The face plate 201 includes a face plate substrate glass 205, a black stripe 206 which is a stopping member formed on the substrate glass 205, an RGB fluorescent object 207, and a metal back 208 for applying a voltage. The rear plate 202 includes a rear plate substrate glass 209, an electronic source generation portion (not shown in FIG. 22) formed on the substrate glass 209, and a driving XY matrix wiring (not shown in FIG. 22). The atmospheric-pressure-resistant support member 204 is provided between the black stripe 206 of the face plate 201 and an upper wiring 210 of the driving XY matrix wiring of the rear plate 202, and is fixed while maintaining predetermined conductivity by conductive adhesive members 211 and 212.

Described below will be the procedure of assembling a flat panel display.

FIG. 13 is a sectional view of the face plate 201. The face plate 201 is provided with an aperture 213 by removing a metal back of the portion to which the atmospheric-pressure-resistive support member is adhered using means such as a laser process, etc. to improve the adhesion as shown in FIG. 14.

Then, a conductive adhesive 214 is applied to an aperture 213 (FIG. 15).

An assembly jig 216 having a positioning member 215 to which the atmospheric-pressure-resistant support member 204 is applied is used so that the atmospheric-pressure-resistant support member of the face plate 201 can be aligned on the position of the adhesion. The atmospheric-pressure-resistant support member 204 is fixed at a predetermined position of the face plate 201 with the conductive adhesive 214 (FIG. 16).

In this step, a face plate member 217 with the atmospheric-pressure-resistant support member 204 fixed at the predetermined position can be obtained (FIG. 17).

Then, a conductive frit, glass 218 and a frame adhering insulating frit glass 219 are applied on the upper wiring 210 of the driving XY matrix wiring on the rear plate substrate glass 209, and are dried and provisionally sintered (FIGS. 18 and 19).

The face plate member 217 to which the atmospheric-pressure-resistant support member 204 is fixed at a predetermined position; the frame 203 to which the insulating frit glass 218 is applied on the face plate side, dried, and provisionally sintered; and the rear plate substrate glass 209 to which the conductive frit glass 218 and the frame adhering insulating frit glass 219 are applied on the upper wiring 210 of the driving XY matrix wiring, dried, and provisionally sintered are mounted at predetermined positions (FIGS. 20 and 21). All these members are heated by an electric furnace or a plate heater, and a frit glass is softened and pressed, thereby obtaining the flat panel display 200 (FIG. 22).

The present invention aims at realizing a method for producing a preferred flat panel display.

DISCLOSURE OF THE INVENTION

An aspect of the present invention relating to a method for producing a flat panel display is configured as follows.

That is, the method produces a flat panel display including a face plate portion and a rear plate portion opposite to each other, and a frame portion. The method is characterized in that it comprises a step of adhering a portion to be adhered between the face plate and the rear plate while guided by a jig. The jig functions as a guide such that the relative positions between the face plate and the rear plate are in a predetermined state at least in a direction within a plane of the plates, and the movement in the interval direction of the face plate and the rear plate can be allowed.

In this method, since the guide in a direction within a plane of the plates is provided by the jig, a flat panel display can be produced with high precision although there is a movement in the interval direction between the face plate and the rear plate. Furthermore, since the face plate and the rear plate can be aligned by the jig setting the positions, the face plate and the rear plate can be aligned although there is a movement in the interval direction between the face plate and the rear plate.

A flat panel display according to the present invention includes a substantially flat face plate portion and a substantially flat rear plate portion. The frame portion between the face plate portion and the rear plate portion can be adhered to the face plate and the rear plate in the step of adhering the frame member to the separately provided face plate and rear plate, or one of the face plate and the rear plate can be adhered to the frame member in advance before the adhering step, and the other is adhered to the frame member in the adhering step. Otherwise, when one of the face plate and the rear plate is produced, the frame portion may be simultaneously produced.

Another aspect of the present invention relating to a method for producing a flat panel display can be configured as follows.

That is, the method produces a flat panel display including a face plate portion and a rear plate portion opposite to each other, and a frame portion. The method has a step of aligning the relative positions between the face plate and the rear plate; a step of positioning a jig for determining relative positions in a direction within a plane of the plates between the face plate and the rear plate by fitting to the face plate and the rear plate in the aligned state; and a step of adhering a portion to be adhered between the face plate and the rear plate while setting the inside relative positions between the face plate and the rear plate using the jig.

According to each of the above mentioned inventions, it is preferable that the adhering step preferably contains a step of applying pressure to the portion to be adhered.

In addition, it is preferable that the adhering step includes a heating step. In the heating step, an adhesive of the portion to be adhered is rendered adhesive. Then, by pressing the portion to be adhered, by simply touching the portion to be adhered, or by pressing after touching the portion to be adhered, the portion to be adhered can be adhered. An adhesive may be, for example, a frit glass.

In each of the above mentioned inventions, it is preferable that the jig includes a sliding portion. The relative positions of a face plate and a rear plate can be set such that either the face plate or the rear plate can touch a sliding member, but it is more preferable that a plate side jig is provided for a face plate or a rear plate, or for both face plate and rear plate such that the plate side jig (corresponding to a face plate fixing plate in the embodiments described below) can touch another portion of a jig (a positioning jig to which a sliding pole corresponds in the embodiments described below).

That is, in each of the above mentioned inventions, either the face plate or the rear plate, or the plate side jig attached to either of them can be moved as touching the positioning jig while a movement in the interval direction is made while suppressing the misalignment between the face plate and the rear plate in a direction within a plane of the plates.

Furthermore, in each of the above mentioned inventions, it is preferable that the jig, the face plate, and the rear plate have substantially equal expansion coefficients at a heating temperature when the adhering step is performed.

In addition, in each of the above mentioned inventions, it is preferable that the flat panel display includes an electron emitting portion and a fluorescent member which becomes fluorescent by an electron emitted by the electron emitting portion. Particularly, it is preferable that the electron emitting portion is provided in the rear plate portion, and the fluorescent member is provided in the face plate portion.

In each of the above mentioned inventions, a support member for maintaining an interval between the face plate portion and the rear plate portion can be provided between the face plate portion and the rear plate portion. The support member can be preferably a member covered with a conductive film.

BEST MODE FOR CARRYING OUT THE INVENTION

First, in the producing method shown in FIGS. 13 through 22, it can be assumed that a frit glass to be heated at 400° C. to 450° C. is used when a face plate and a rear plate are adhered and fixed to guarantee the air-tightness to maintain the heat-resistance and vacuum required when a heat-aging process and a baking processes are performed in the subsequent steps.

Figure 16:
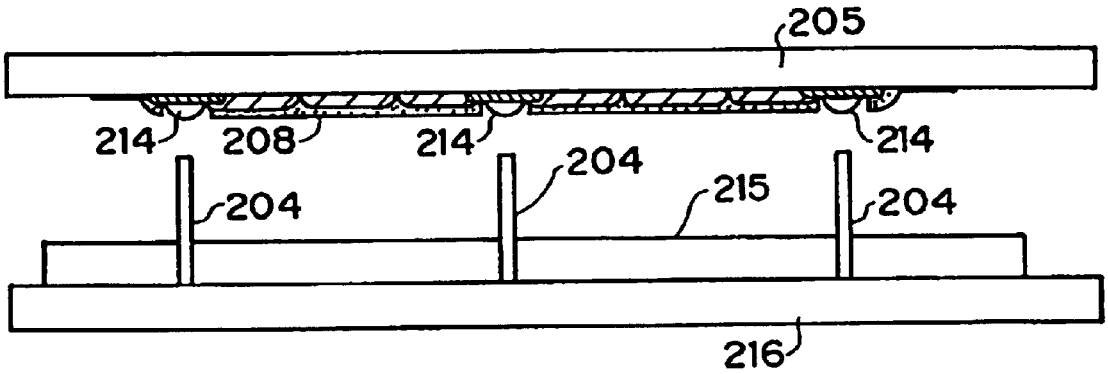
FIG. 16 is an explanatory view of a conventional technology.
Figure 17:
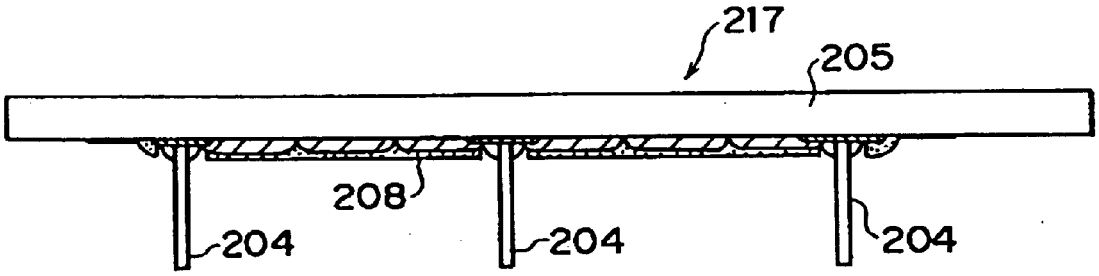
FIG. 17 is an explanatory view of a conventional technology.
Figure 18:
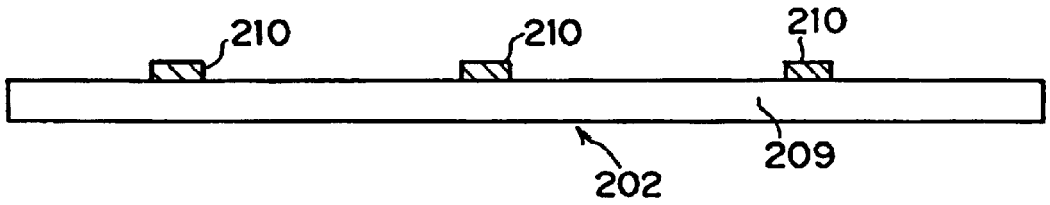
FIG. 18 is an explanatory view of a conventional technology.
Figure 19:
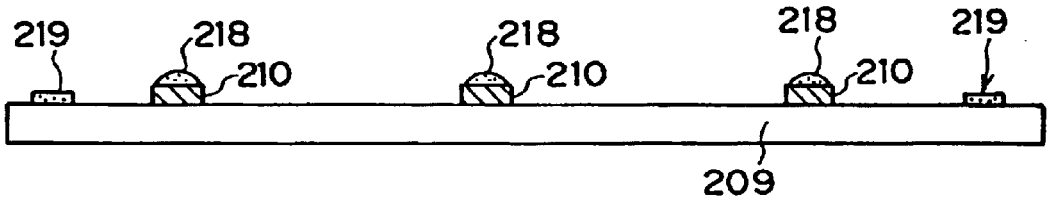
FIG. 19 is an explanatory view of a conventional technology.
Figure 20:
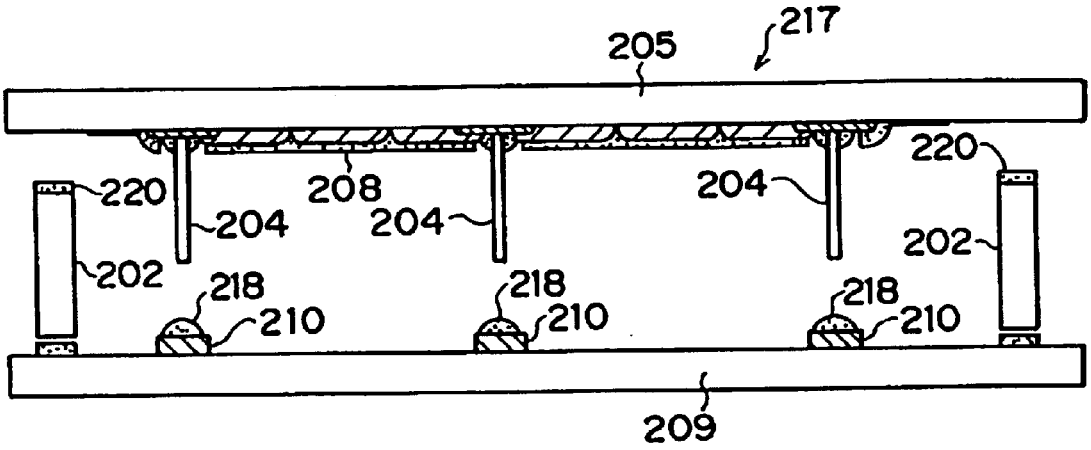
FIG. 20 is an explanatory view of a conventional technology.
Figure 21:
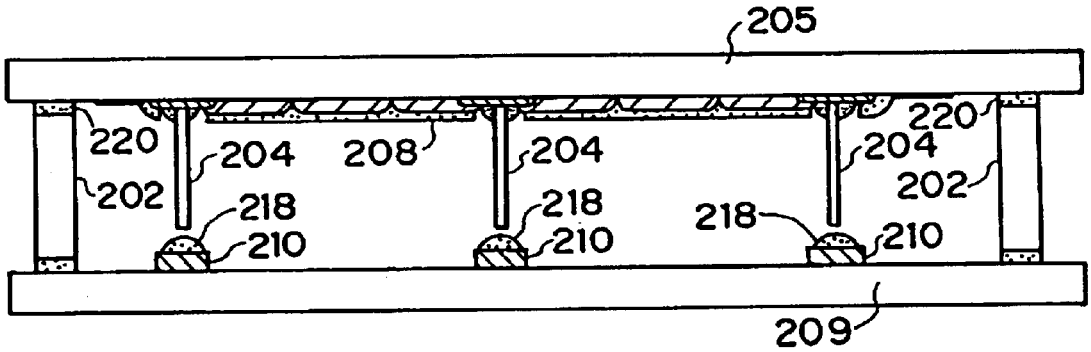
FIG. 21 is an explanatory view of a conventional technology.
Figure 22:
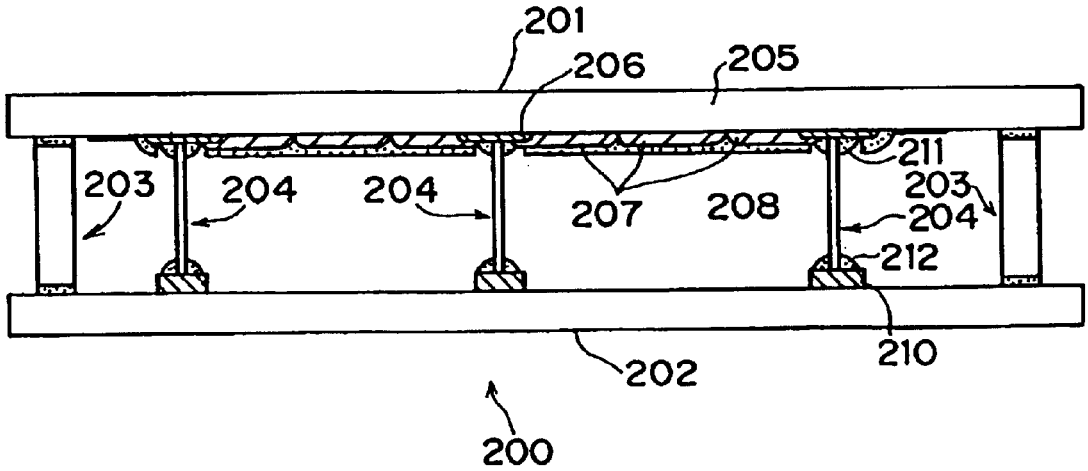
FIG. 22 is an explanatory view of a conventional technology.

It is also assumed that an atmospheric-pressure-resistant support member is provided in the flat panel display to stand the atmospheric pressure. The frit glass of the frame portion is formed thicker before the heating process than after the heating process as shown in FIG. 16 to guarantee the strength and the air-tightness so that the adhered layer can be formed by thinning it by the heating and pressing operations. The thickness depends on the structure and the size of the member, but is about 0.5 to 2 mm. Since the frit glass has a subtraction allowance, the face plate and the rear plate are aligned at the room temperature, and the discrepancy in position in the XY direction arises when the frit glass becomes lower in the method in which the heating process is performed after the fixing using a clip, etc., thereby making it difficult to obtain a flat panel display with high position precision.

Plate heaters above and below the face plate and the rear plate evenly heat them when they are aligned. Then, the frit glass is softened and then pressed, the aligning process is performed, the temperature is evenly lowered, and the aligning process is continued until the frit glass is hardened. Thus, the process of obtaining a flat panel display with-high position precision requires a complicated and costly system, and a long processing time.

Furthermore, as disclosed by Japanese Patent Application Laid-Open No. 9-50767, a fine groove is made on the display portion of the substrate to perform an aligning process through insertion. However, the process of making a groove is complicated and costly, and cannot attain a sufficient fixing effect because the depth of the groove is small.

The embodiment of the present invention described below has been developed to solve the above mentioned problem.

The preferred embodiment of the method for producing the flat panel display according to the present invention is described below by referring to the attached drawings.

The embodiment is an example of producing an image generation device using a surface conductive electron emission element.

FIGS. 1 through 12 sequentially show the producing process according to the present embodiment.

Figure 1:
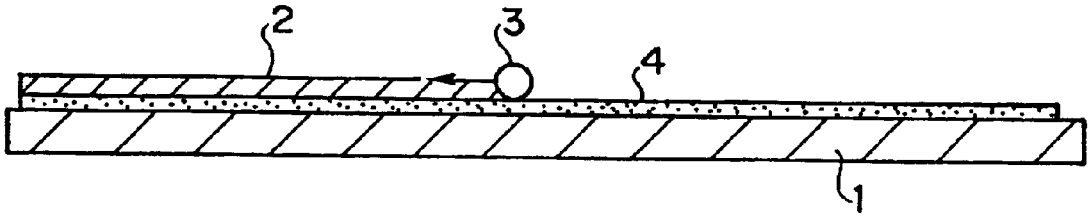
FIG. 1 shows a step of the method for producing a flat panel display according to the present invention.
Figure 2:
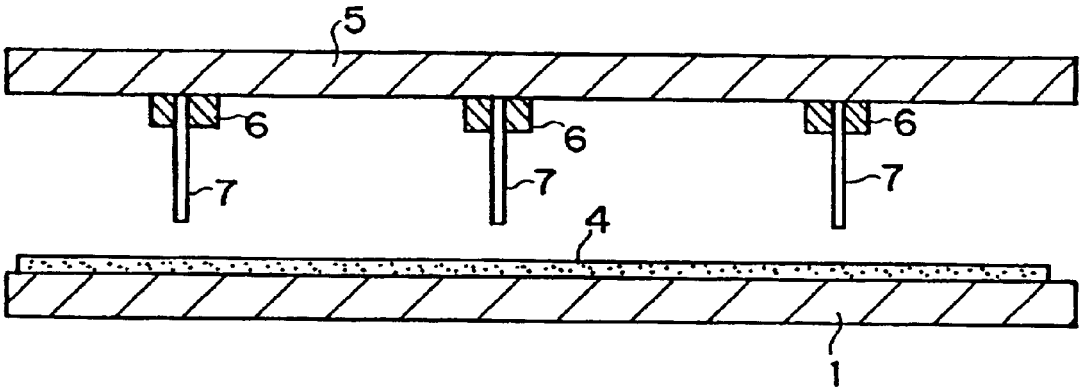
FIG. 2 shows a step of the method for producing a flat panel display according to the present invention.

In FIG. 1, an inorganic adhesive 2 containing silver powder is applied to an application stand 1, and an applicator 3 forms a thin layer 4 of a conductive adhesive.

The silver powder is an average of 3 to 5 micron grain, and the inorganic adhesive is a reactive silicates adhesive. According to the present embodiment, the heat-resistant inorganic adhesives 'Aron Ceramic W' (commercially available) of Toagosei Co., Ltd. in an average of 3 to 5 micron grain is used. The silver powder and the inorganic adhesive are mixed at the weight ratio of 20:80, and used as a conductive adhesive.

Figure 3:
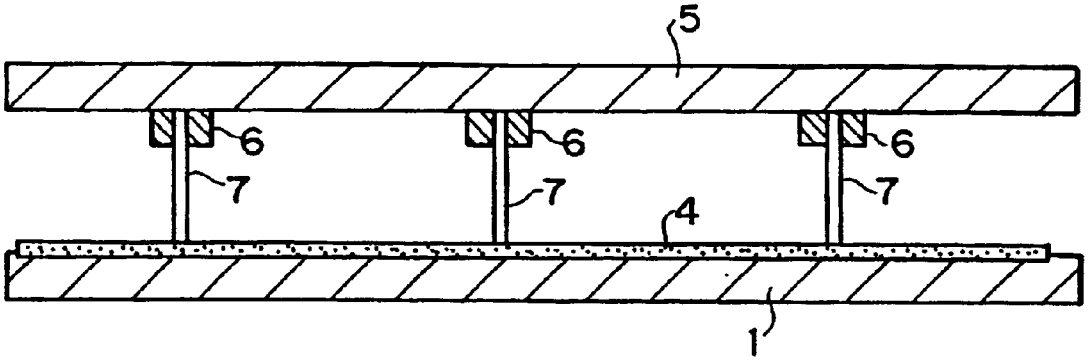
FIG. 3 shows a step of the method for producing a flat panel display according to the present invention.
Figure 4:
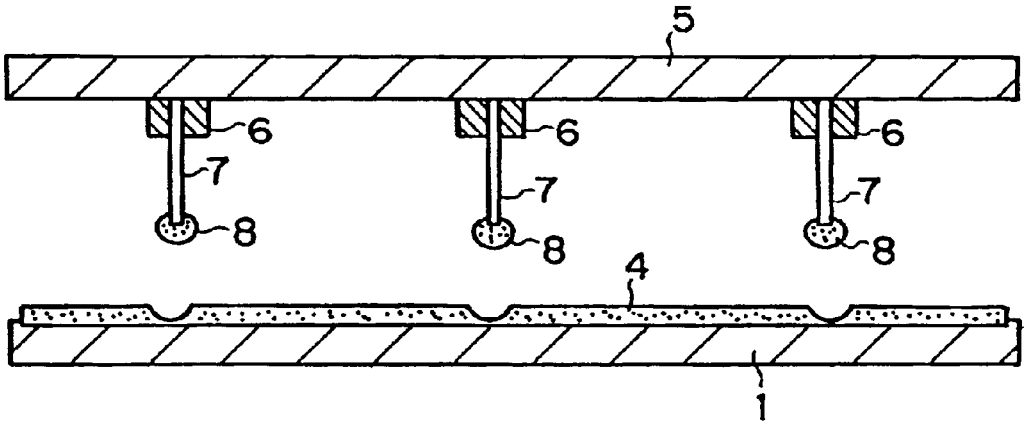
FIG. 4 shows a step of the method for producing a flat panel display according to the present invention.

Then, an atmospheric-pressure-resistant support member 7, which is 0.2 mm thick and has a conductive layer on the surface, is set at predetermined intervals by a jig 5 having a chucking member 6 (FIG. 2), and the thin layer 4 of the conductive adhesive touches one end of the atmospheric-pressure-resistant support member 7 (FIG. 3). By raising the jig 5, a conductive adhesive lump 8 is formed at the end of the atmospheric-pressure-resistant support member 7 (FIG. 4).

Figure 5:
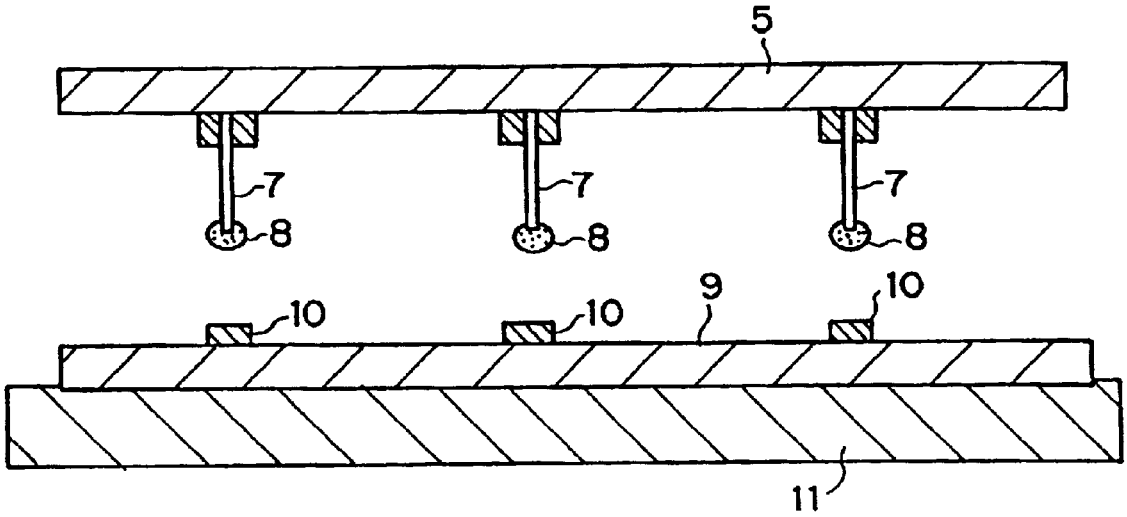
FIG. 5 shows a step of the method for producing a flat panel display according to the present invention.
Figure 6:
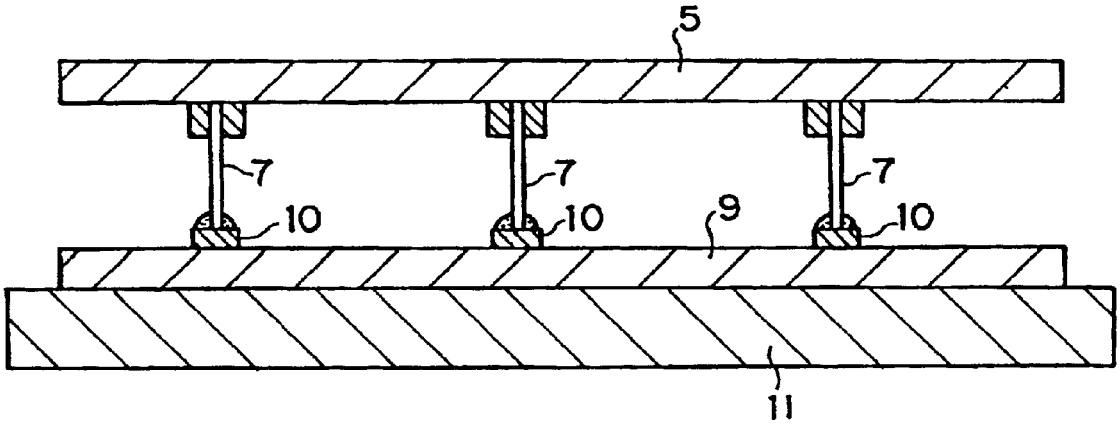
FIG. 6 shows a step of the method for producing a flat panel display according to the present invention.

Then, the atmospheric-pressure-resistant support member 7, at whose end the conductive adhesive pit 8 is formed by the jig 5, is set over a rear plate 9 fixed on a heating stand 11, and touches an upper wiring 10 of the driving XY matrix wiring on the rear plate 9 (FIGS. 5 and 6).

The conductive adhesive touches the upper wiring 10 of the driving XY matrix wiring on the heated rear plate 9, is heated up to 200° C., and is hardened. At this time, the indium metal powder in the conductive adhesive is fused, and the atmospheric-pressure-resistant support member 7 is fixed on the upper wiring 10 of the driving XY matrix wiring on the rear plate 9, and electrically connected.

Figure 7:
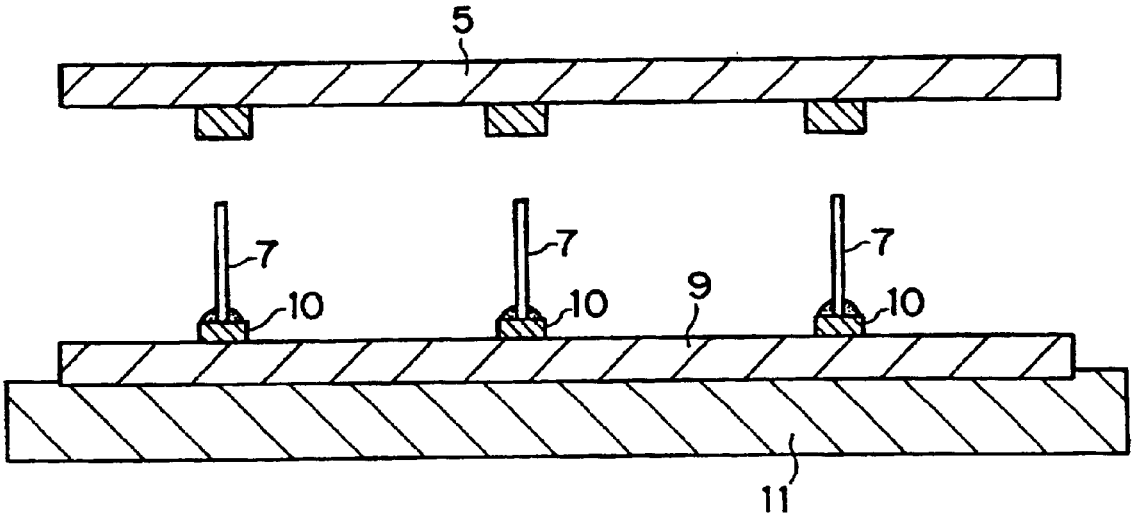
FIG. 7 shows a step of the method for producing a flat panel display according to the present invention.
Figure 8:
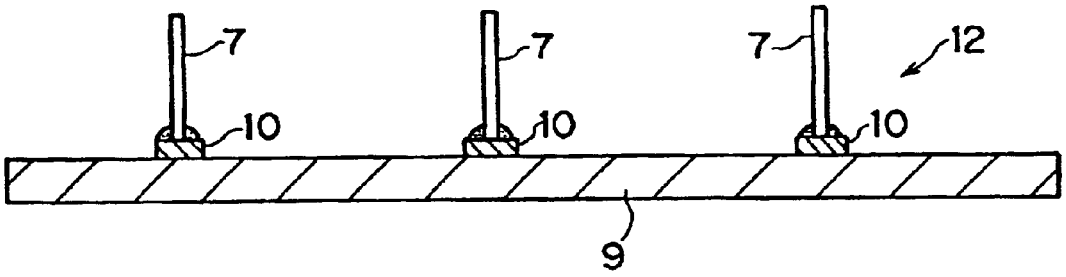
FIG. 8 shows a step of the method for producing a flat panel display according to the present invention.

After hardening the conductive adhesive, the jig 5 is raised, and the rear plate 9 is removed from the heating stand. Thus, a rear plate 12 is obtained by fixing the atmospheric-pressure-resistant support member 7 on the upper wiring 10 of the driving XY, matrix wiring (FIGS. 7 and 8).

Then, an insulating frit glass 20 for adhering the frame is applied to the portion onto which the frame touches on a face plate substrate 14 on which a black stripe 16, which is a stopping member, an RGB fluorescent object 17, and a voltage applying metal back 18 are formed on a face place glass substrate 15. The applied insulating frit glass 20 is dried, and provisionally sintered.

Figure 9:
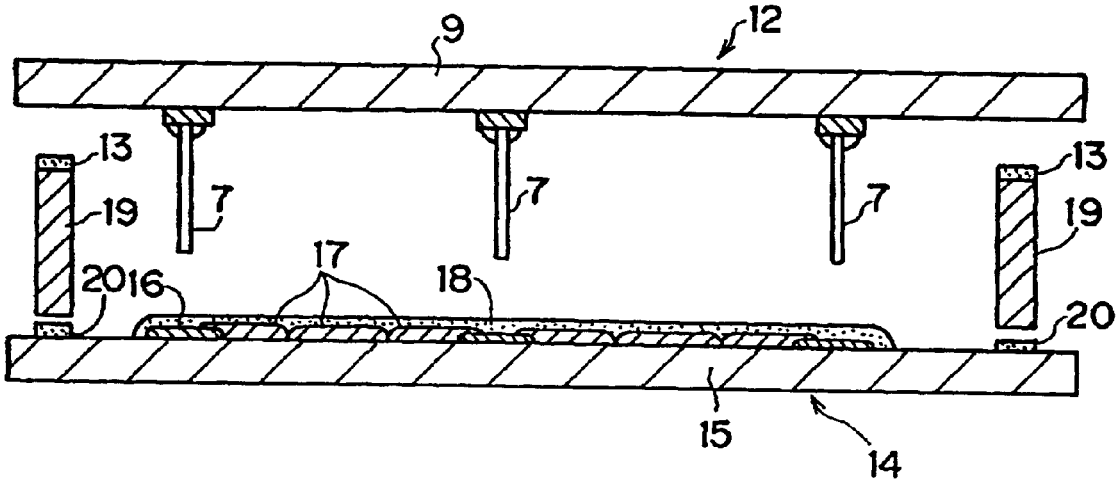
FIG. 9 shows a step of the method for producing a flat panel display according to the present invention.

The rear plate material 12 on which the atmospheric-pressure-resistant support member 7 is fixed at a predetermined position, a frame 19 on which an insulating frit glass 13 is applied on the rear plate side, dried, and provisionally sintered, and the face plate substrate 14 to which the insulating frit glass 20 for adhering the frame is applied, dried, and provisionally sintered are set at predetermined positions (FIG. 9).

Figure 10:
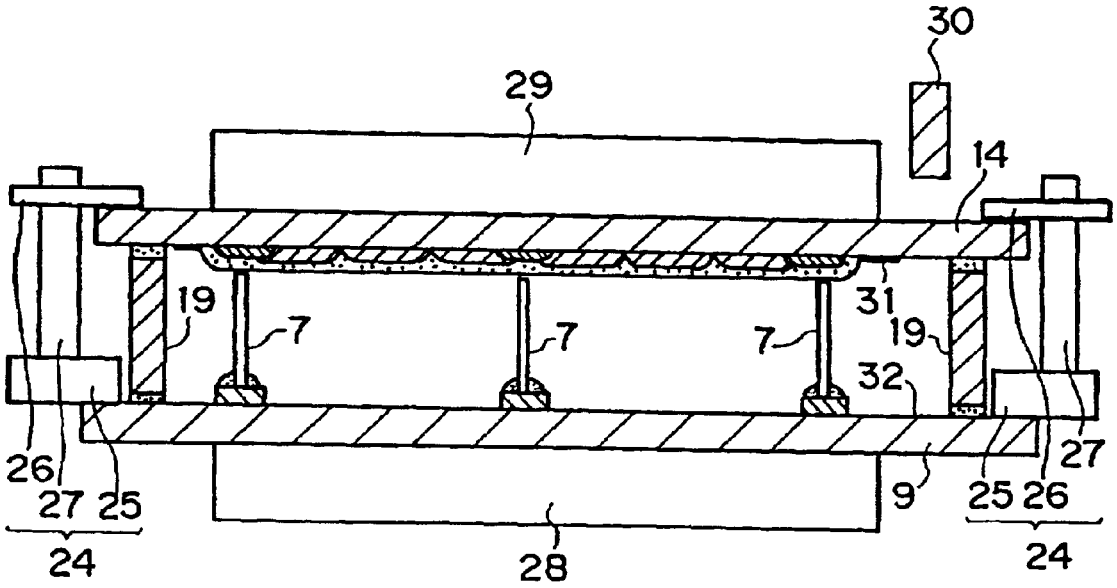
FIG. 10 shows a step of the method for producing a flat panel display according to the present invention.

The positions of the face plate 14 and the rear plate 9 are set in the X and Y directions by a face plate fixing jig 29 and a rear plate fixing jig 28. In this case, a face plate alignment mark 31 and a rear plate alignment mark 32 are aligned by monitoring through a CCD camera 30, and fixed by a fixing jig 24 movable in the thickness direction (FIG. 10).

The fixing jig 24 movable in the thickness direction comprises a rear plate fixing plate 25, a face plate fixing plate 26, and a sliding pole 27. The sliding pole 27 is fixed to the rear plate fixing plate 25, and the face plate fixing plate 26 moves up and down along the hole into which the sliding pole 27 fits. These fixing jigs are made of ceramics ('Photoveel' preferably) which can be cut and have substantially the same expansion coefficient as the glass substrate used for the face plate 14 and the rear plate 9. The rear plate fixing plate 25 is adhered to the rear plate 9 with the inorganic adhesive, and is then aligned. Then, the face plate fixing plate 26 is adhered to the face plate 14.

Figure 11:
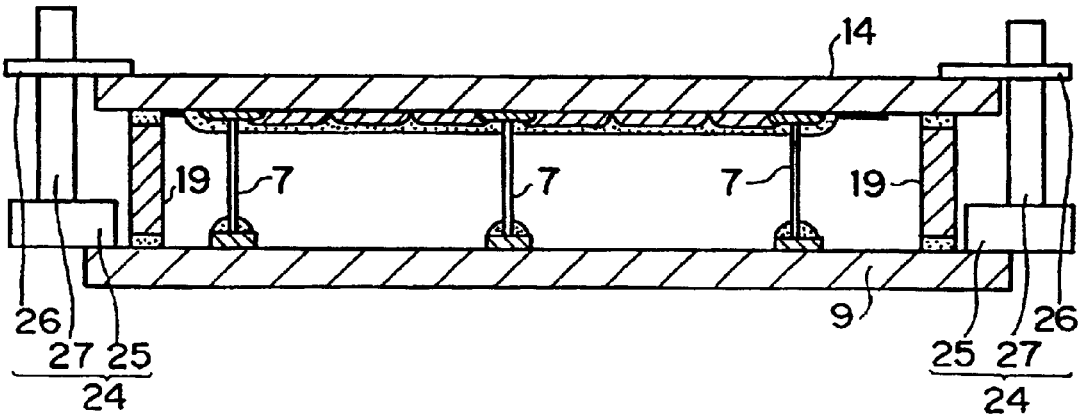
FIG. 11 shows a step of the method for producing a flat panel display according to the present invention.
Figure 12:
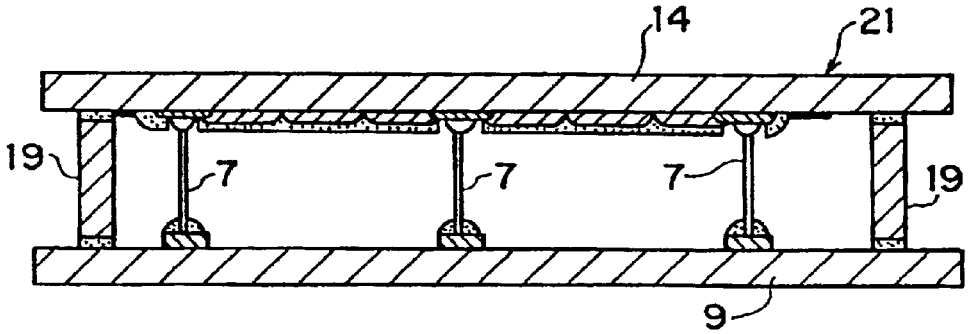
FIG. 12 shows a step of the method for producing a flat panel display according to the present invention.
Figure 13:
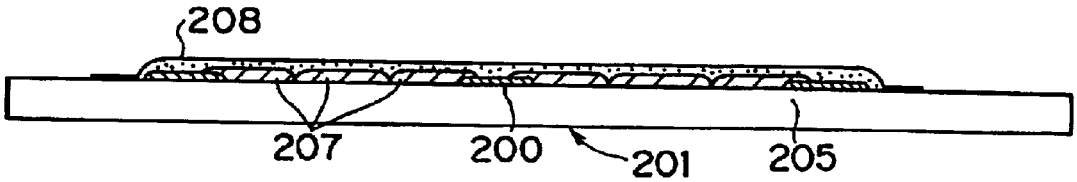
FIG. 13 is an explanatory view of a conventional technology.
Figure 14:
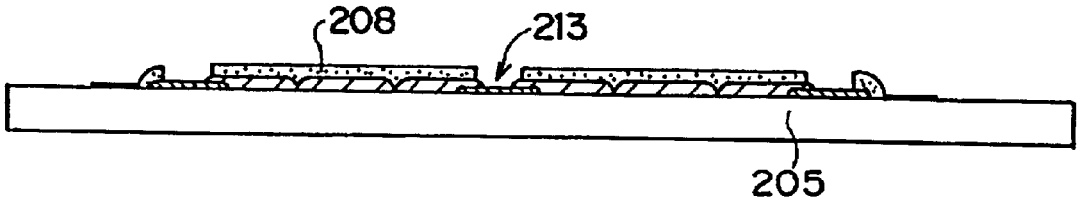
FIG. 14 is an explanatory view of a conventional technology.
Figure 15:
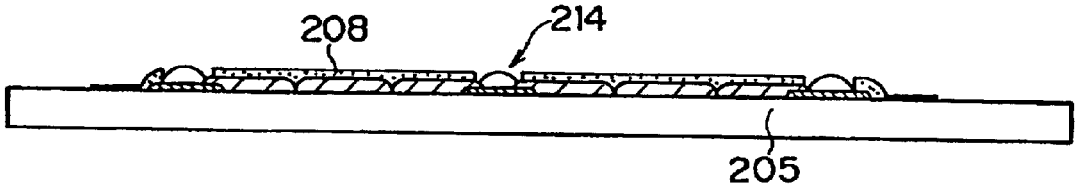
FIG. 15 is an explanatory view of a conventional technology.

The face plate 14 and the rear plate 9 fixed by the fixing jig 24 movable in the thickness direction are heated up to the temperature at which the frit glass is softened. The entire panel is pressed such that the frit glasses 13 and 20 at portions of the frame 19 can be spread to obtain the strength and the air-tightness. After the spread, the glasses are cooled, and a flat panel display 21 is obtained (FIGS. 11 and 12).

According to the present invention, the position discrepancy does not occur in the XY direction unlike the conventional technology when the frit glasses are lowered, thereby successfully producing an image forming apparatus with high position and size precision in a short-time process and a simple method.

As described above, according to an embodiment of the present invention, a face plate and a rear plate are aligned, they are fixed with a fixing jig movable in the thickness direction of a flat panel display, the rear plate, the face plate, and the frame member are heated up to the adhering temperature, and a load is applied in the thickness direction of the flat panel display to cause adhesion, thereby easily producing the apparatus with high precision.

In addition, in a method in which an assembling process is performed by providing aligning means, such as penetration hole, on the face plate or the rear plate after providing a fluorescent member, an acceleration electrode, an electron emission element, wiring, etc. on the face plate and the rear plate, it is necessary to mechanically form a hole, etc. in a glass substrate. The machining precision for a glass substrate within an error of +50 micron is quite difficult. In the above mentioned embodiments, after a face plate and a rear plate are aligned, they are fixed with a fixing jig movable in the thickness direction of a flat panel display, the rear plate, the face plate, and the frame member are heated up to the adhering temperature, and a load is applied in the thickness direction of the flat panel display to cause adhesion. The plate side jig and the sliding pole can slide without providing a sliding portion for the face plate or the rear plate. Therefore, the position precision in assembling can be obtained with an error of +10 micron.

Furthermore, by using the jig described by referring to the above mentioned embodiments, the alignment can be preferably performed between a face plate and a rear plate. As a result, once the face plate, the rear plate, and the jig are positioned at predetermined relative positions, the face plate and the rear plate can be separate, a vacuum chamber is exhausted, and then an adhering step is performed, thereby easily setting the atmosphere in the flat panel display in a preferable state. Even after separating the face plate from the rear plate, the aligned status can easily be realized for successful adhesion.

As described above by referring to a practical embodiment, the present invention can provide a preferred method for producing a flat panel display.

INDUSTRIAL APPLICABILITY

The present invention can be effectively utilized in the field of a flat panel display, and can easily produce flat panel displays with high precision.

What is claimed is:

1. A method for producing a flat panel display, comprising a first plate and a second plate opposite each other, and a frame portion, said method comprising the steps of:

aligning relative positions between the first plate and the second plate in a lateral direction;

setting a jig to the first plate and the second plate, which are laterally aligned with each other, with the jig having a sliding portion;

adhering the frame portion between the first plate and the second plate; and while maintaining the relative positions between the first plate and the second plate, allowing the sliding portion of the jig to permit movement of the first and second plates relative to each other in a direction transverse to the lateral direction.

2. The method according to claim 1, wherein that said adhering step comprises a step of applying pressure to said portion to be adhered.

3. The method according to claim 1, wherein said adhering step comprises a heating step.

4. The method according to claim 1, wherein a first portion of said jig comprises a plate side jig fixed to said first plate, and said plate side jig touches the sliding portion.

5. The method according to claim 1, wherein the flat panel display comprises an electron emitting portion and a fluorescent member which becomes fluorescent by an electron emitted by the electron emitting portion.

6. The method according to claim 5, wherein the electron emitting portion is provided in the second plate portion.

7. The method according to claim 5, wherein the fluorescent member is provided in the first plate portion.

8. The method according to claim 5, further comprising the step of providing a support member between the first plate portion and the second plate portion, for maintaining an interval between the first plate portion and the second plate portion.

9. A method for producing a flat panel display, comprising a first plate and a second plate opposite each other, and a frame portion, said method comprising the steps of:

adhering the frame portion between the first plate and the second plate while guided by a jig, with relative positions between said first plate and said second plate being in a predetermined state in a lateral direction; and allowing the jig to permit movement in an interval direction of the first plate and the second plate transverse to the lateral direction, wherein the jig, the first plate, and the second plate have substantially equal expansion coefficients at a heating temperature when said adhering step is performed.

10. The method according to claim 9, wherein said jig includes a sliding portion for allowing the movement in the interval direction.

* * * * *

UNITED STATES PATENT AND TRADEMARK OFFICE

CERTIFICATE OF CORRECTION

PATENT NO. : 6,908,354 B1
DATED : June 21, 2005
INVENTOR(S) : Kohei Nakata

It is certified that error appears in the above-identified patent and that said Letters Patent is hereby corrected as shown below:

Title page,
Item [75], Inventor "Tokyo (JP)" should read -- Machida (JP) --.

Column 1,
Line 5, "designated" should read -- designated in --.
Line 59, "frit," should read -- frit --.

Column 2,
Line 1, "glass 218" should read -- glass 219 --.

Column 7,
Line 17, "that" should be deleted.

Signed and Sealed this

Fourteenth Day of March, 2006

JON W. DUDAS
*Director of the United States Patent and Trademark Office*